US005204511A

United States Patent [19]

Baitz et al.

[11] Patent Number: 5,204,511

[45] Date of Patent: Apr. 20, 1993

[54] ALPHANUMERIC KEYBOARD

[75] Inventors: Günter Baitz, Berlin; Joachim Burchart, Schlangen, both of Fed. Rep. of Germany

[73] Assignee: Siemans Nixdorf Informationssysteme AG, Paderborn, Fed. Rep. of Germany

[21] Appl. No.: 688,934

[22] PCT Filed: Oct. 25, 1989

[86] PCT No.: PCT/EP89/01274

§ 371 Date: Jun. 10, 1991

§ 102(e) Date: Jun. 10, 1991

[87] PCT Pub. No.: WO90/05372

PCT Pub. Date: May 17, 1990

[30] Foreign Application Priority Data

Nov. 11, 1988 [DE] Fed. Rep. of Germany ..... 3838362

[51] Int. Cl.[5] ..... G06C 7/02; H01H 9/26

[52] U.S. Cl. ..... 235/145 R; 235/145 A; 200/5 A

[58] Field of Search ..... 235/145 R, 145 A, 146; 200/5 A, 6 A, 16 A, 17 R, 18

[56] References Cited

U.S. PATENT DOCUMENTS 3,523,184 8/1970 Vogel ..... 235/145 R 4,760,221 7/1988 Yoshida et al. ..... 200/5 A

FOREIGN PATENT DOCUMENTS 0267541 5/1988 European Pat. Off. .

0282817 9/1988 European Pat. Off. .

7234411 1/1973 Fed. Rep. of Germany .

2259052 6/1974 Fed. Rep. of Germany .

OTHER PUBLICATIONS

IBM Technical Disclosure Bulletin, vol. 31 No. 1 Jun. 1988 "Triangular Toggle keys for Touch Tone Phone" pp. 47–48.

IBM Technical Disclosure Bulletin, vol. 21 No. 12 May 1979, "Digital Joystick Switch" pp. 4962–4964.

*Primary Examiner*—Michael L. Gellner

*Assistant Examiner*—Eddie C. Lee

[57] ABSTRACT

An alphanumeric keyboard comprises a plurality of key operated switches and a cover frame which covers the switches and has bosses for receiving switch operating rams carried by key buttons having projections which receive the rams and which fit into the bosses. At least one compound key of the keyboard is associated with at least two switches and includes a compound key head which overlies at least two bosses. At least one of the rams of this compound key is so mounted on the compound key head that it can be adjusted relative to the compound key head parallel to the keying direction.

11 Claims, 6 Drawing Sheets

ALPHANUMERIC KEYBOARD

Figure 1:
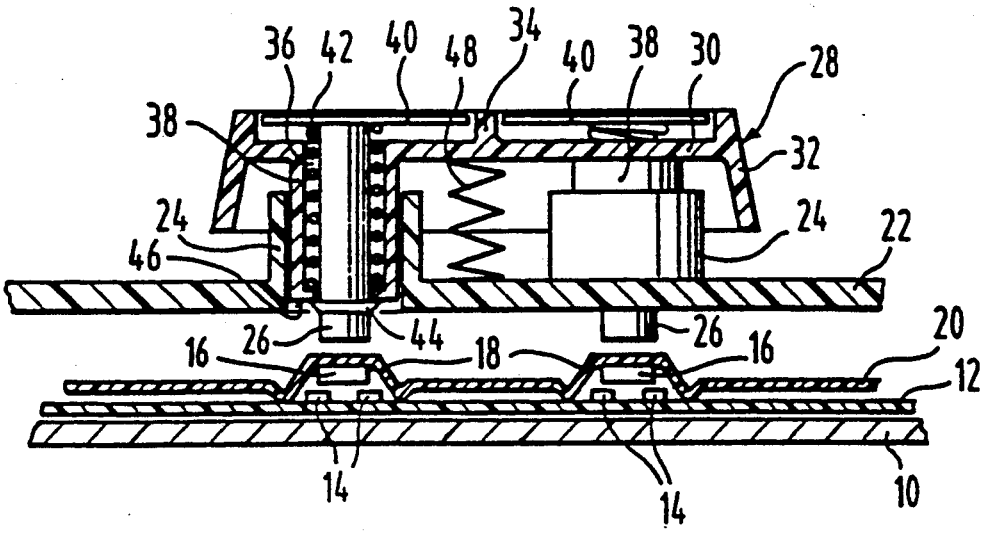

The invention concerns an alphanumeric keyboard including a plurality of switches operable by keys and a cover frame covering the switches and having guide bosses for key rams, which key rams are connected with a key head overlying the guide bosses.

In a keyboard of this type known from DE-C2-33 25 409 the possibility exists for constructing different keyboards using the same cover frame while different groups of guide bosses are equipped with keys. The unused guide bosses are closed by caps. This indeed permits variation possibilities in the manufacture of keyboards. The functions of the once manufactured keyboard can above all no longer be changed.

A keyboard is known from European Patent Application 0 267 541 in which a keyboard is connected with a plurality of rams. The rams however are not independently adjustable from the key head. The same applies to the key arrangement described by IBM Technical Disclosure Bulletin, June 1988, pages 47 to 49.

European Patent Application 0 282 817 shows a rotary selector switch inside of which are arranged four key operated switches. This arrangement does not however provide a key head on which a number of rams are so arranged that the rams can be made to operate either in common or independently of one another on the switches.

The invention has as its object the provision of a keyboard of the previously mentioned type wherein while keeping the same keyboard construction an operational change of the keyboard functions is permitted.

The solution of this object as proposed in accordance with the invention is that at least one compound key is associated with at least two switches with the compound key having at least one key head overlying at least two guide bosses, and that at least one ram of this compound key is supported on the key head for adjustment parallel to the keying direction.

With the solution provided by the invention the possibility exists of actuating switches individually or in combination with other switches. Depending on the number of rams and switches associated with one compound key head a selection can also be made between different combinations. In this way the functions of the keyboard can be expanded without having to increase the number of switches and keys.

According to a first embodiment at least one adjustable ram is connected with a compound key head and so supported on the key head that it by means of a push on the key head is moveable to effect a switch actuation in common with the one or more other rams and is also moveable independently of the one or more other rams by a pressing of its key button to effect a switch actuation. That is, the keys combined in a common or compound key head are actuatable either individually or in common.

In a further embodiment the at least one adjustable ram is selectively adjustable relative to the compound key head between an effective position, in which it upon a pressing down of the key head operates the associated switch, and an ineffective position, in which it upon a pressing down of the key head does not operate the associated switch. This produces the possibility upon the pressing down of a key head of selectively actuating all of the associated switches or only a given combination of switches or also only a single switch. To assure a reliable actuation of the switch the adjustable ram is preferably detained in its effective and/or its ineffective position.

To make possible an operative adjustment of the ram without disassembly of the keys as heretofore necessary, it is proposed in accordance with the invention that the adjustable ram be guided in a nipple connected with the key head and be biased to its ineffective position and that a positioning element be moveably arranged on the key head which positioning element works on the end of the ram remote from the switch and is operable from the upper side of the key head. The actuation can take place in different ways. In a very simple to manufacture and reliable embodiment the positioning element is arranged for radial movement relative to the ram and is provided with a ramp slidable onto the end of the ram facing the key head. This positioning element can therefore be connected with a slide moveable over the upper side of the key head or to a rotary knob supported on the upper side of the key head.

Instead of the above described positioning element provided with a ramp, the positioning element can also be one including a pivotally supported cam.

In order to make certain key combinations accessible only to authorized persons the positioning element can be made to be one only operable by means of an unlocking key.

Figure 2:
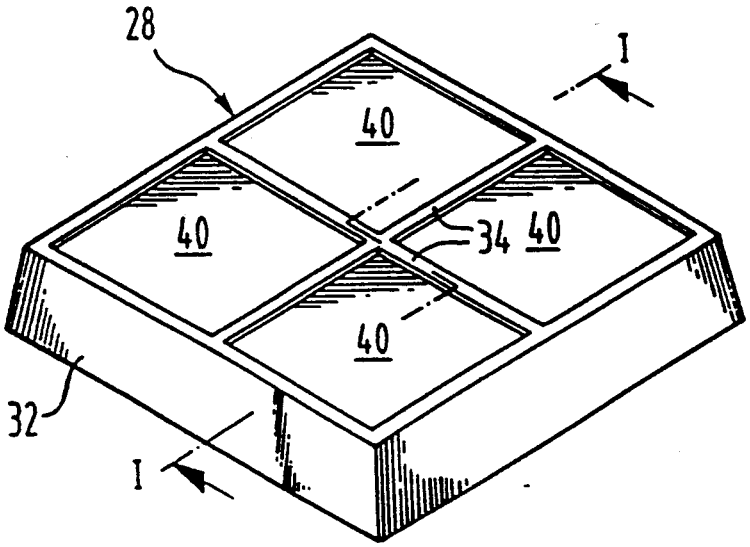

Further features and advantages of the invention will be apparent from the further dependent claims and from the following description which in combination with the accompanying drawings explain the invention by way of exemplary embodiments. The drawings show:

FIG. 1—A schematic partial section through a keyboard embodying the invention and taken along the line I—I of FIG. 2.

FIG. 2—A perspective plan view of a key head with four individual keys.

Figure 3:
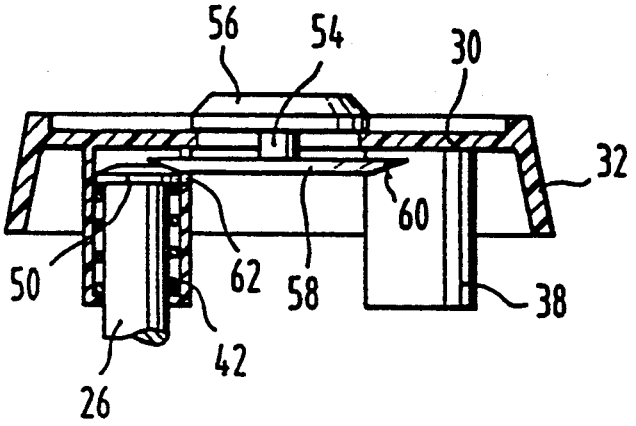
Figure 4:
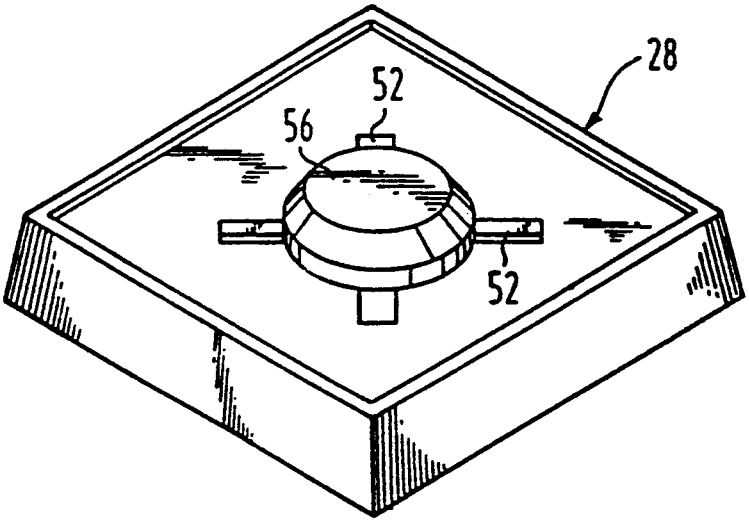

FIGS. 3 and 4—Views corresponding to FIGS. 1 and 2 but of a second embodiment with the cross section of FIG. 3 showing only the key itself.

Figure 5:
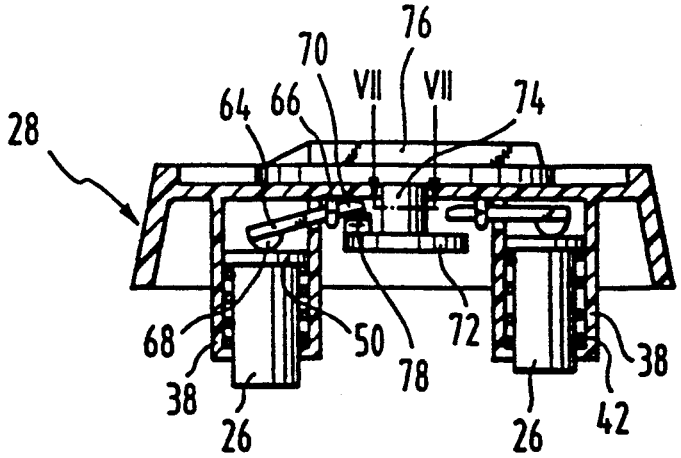
Figure 6:
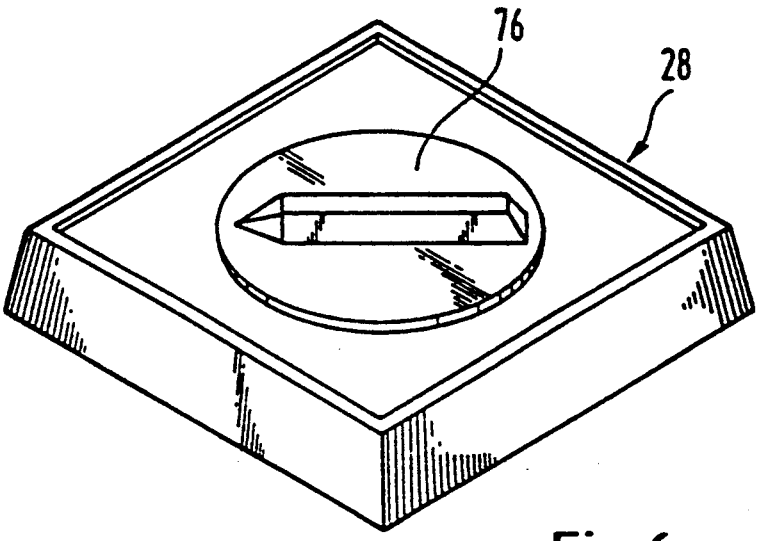

FIGS. 5 and 6—Illustrations corresponding to FIGS. 3 and 4 but showing a third embodiment of the invention.

Figure 7:
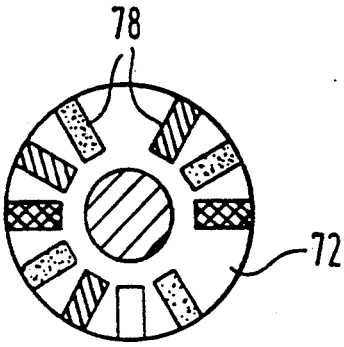

FIG. 7—A section taken along the line VII—VII of FIG. 5.

Figure 9:
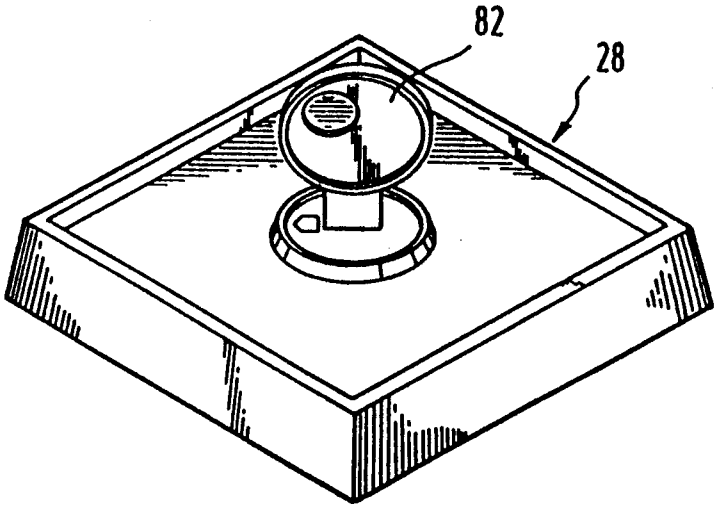
Figure 8:
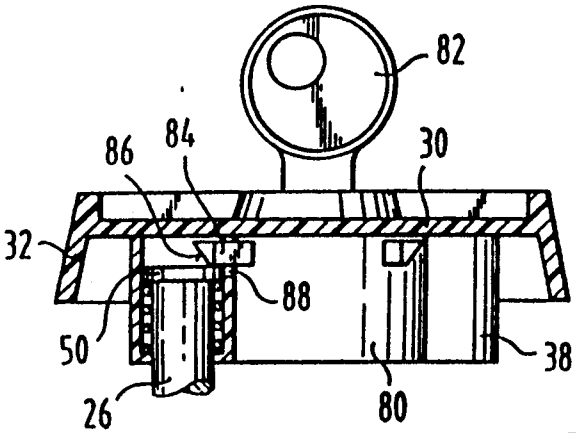

FIGS. 8 and 9—Illustrations corresponding to FIGS. 3 and 4 but showing a fourth embodiment.

Figure 10:
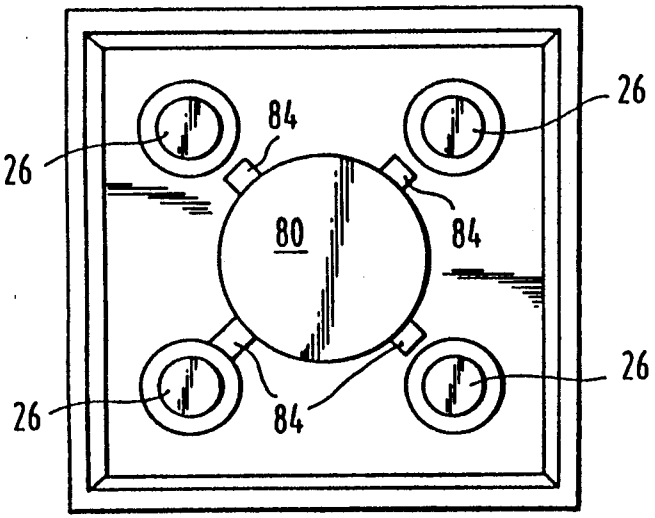

FIG. 10—A bottom view of the key illustrated in FIGS. 8 and 9.

FIGS. 11 to 18—Views similar to FIGS. 3 and 4 but showing four further embodiments of the invention wherein the compound key of each embodiment includes only two individual keys.

Figure 17:
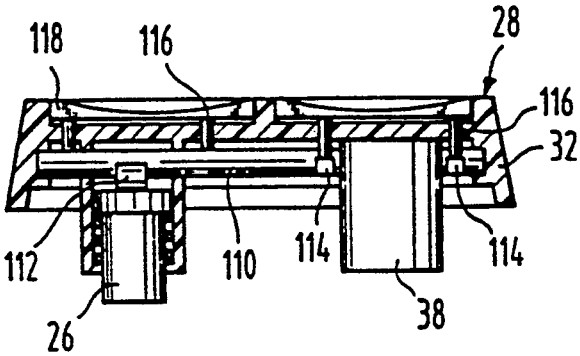
Figure 18:
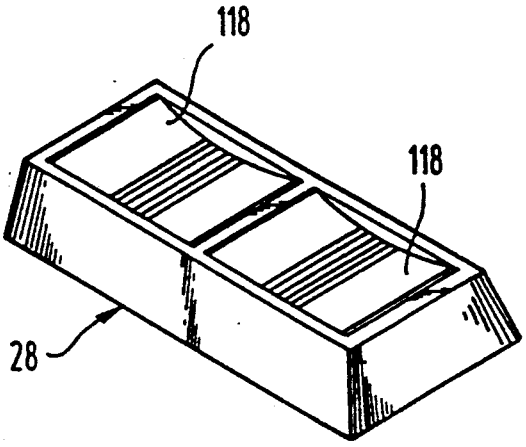
Figure 19:
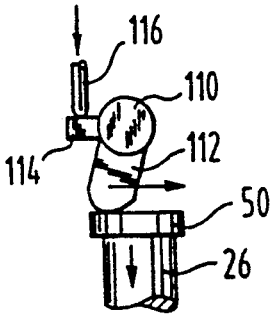

FIG. 19—A schematic detailed view of the adjusting mechanism for adjusting a ram in the embodiment of FIGS. 17 and 18.

Since the present invention is concerned only with the improvement of the keys of a keyboard, the keyboard is only schematically and fragmentarily shown in FIG. 1. It includes a housing, indicated only by a bottom wall 10, in which is arranged a carrier 12 for contact strips 14. The carrier 12, for example, may be a circuit board. Associated with each two contact strips 14 is a bridge element 16 which can connect the two contact strips, so that the two contact strips 14 and the associated bridge element 16 form a switch. The bridge elements 16 are arranged in protuberances 18 formed in an elastic mat 20 lying over the carrier 12. By the application of pressure to the protuberances 18 the bridge elements 16 can be pressed against the contact strips 14. When the pressure is released, the protuberances 18 because of the elasticity of the mat 20 return to their original positions, so that the bridge elements 16 are lifted from the contact strips 14.

The housing is closed by a cover frame 22 which above each protuberance 18 and each switch 14,16 has a guide boss 24 with a bore, extending generally perpendicularly to the cover frame, through which a ram 26 can operate on the associated projection 18 and thereby on the associated switch 14,16. The keyboard as so far described is known in itself and the construction of the switches can take whatever form desired so long as it is possible for them to be operated by rams received in the guide bosses.

In the embodiment illustrated in FIGS. 1 and 2 four individual keys are combined into a compound key. This compound key includes a compound key head 28 in the form of a square shallow cap with a cover wall 30 and a rim 32 surrounding the cover wall. The cover wall is divided on its upper side by ribs 34 into four areas each of which has a central opening 36. Connected with each opening on the under side of the cover wall 30 is a cylindrical nipple 38 whose diameter is so chosen that it can be received in a guide boss 24 with little play. A key ram 26 is slidably received in each nipple 38 with the ram on its upper end being connected with a key button 40 filling in the associated area of the key head 28. This individual key consisting of a key ram 26 and key button 40 is biased to the contact free position illustrated in FIG. 1 by a helical compression spring 42 surrounding the ram 26 with a movement of the ram out of the nipple 38 being prevented by a lip 44 on the ram 26 which abuts a radially inwardly directed flange 46 on the lower end of the nipple 38. This flange 46 serves at the same time as an abutment for the helical compression spring 42.

The compound key head 28 in its entirety is biased toward the contact free position by a spring 48.

It will be understood that with a pressing of the key head 28 the individual keys are actuated, so that the four switches 14,16 positioned thereunder are simultaneously closed. On the other hand it is also possible to actuate each of the individual keys 26,40 individually or in a desired combination, in which case the user presses only the key buttons 40 of the desired individual keys. The key head 28 in this case remains in its upper position.

In the embodiment of FIGS. 3 and 4 similar parts are provided with the same reference numbers. In this case there are also four individual keys combined into one compound key with a common or compound key head 28. The openings 36 in the cover wall 30 are not provided in this embodiment and instead the nipples 38 are closed at their upper ends. Each ram 26 has a head 50 at its end facing the cover wall 30, which head diminishes conically toward its free end. The head serves as an abutment for the helical spring 42 which biases the associated ram 26 to its upper position.

Two intersecting slots 52 are formed in the cover wall 30 along the diagonals of the square key head. A pin 54 passes through the slots 52 and at its upper end is connected with an actuating button 56 slidable over the upper surface of the cover wall 30, the pin 54 at its lower end carrying a disc 58 whose edge surface 60 is beveled as a ramp. If the slide consisting of the actuating button 56, the pin 54 and the disc 58 is pushed in the direction toward one of the ends of the slots 52 the disc extends into a slot 62 in the one of the nipples 38 associated with the involved slot end and slides onto the head 50 of the associated key ram 26 with the result that this ram is pushed downwardly against the force of its spring 42. In this lowered position this ram can by a pushing down of the key head 28 be made to operate its associated switch 14,16. The other rams on the other hand are biased upwardly by their springs so that upon the pressing down of the or compound key head 28 they cannot close their associated switches 14,16. Therefore, by the shifting of the actuating button 56 the switch which is to be closed by the pressing of the key head can be chosen.

The embodiment according to FIGS. 5 and 6 differs from the embodiment according to FIGS. 3 and 4 only in the type of adjustment of the rams. Each key ram 26 is associated with a two armed pivotal lever 64 directed radially of the associated ram, which lever, as indicated at 66, is pivotally supported by the cover wall 30. Each lever 64 extends with one of its arms to the ram 26 and lies on the head 50 of the ram 26 with a cam 68. With its arm 70 which is located remote from the key ram 26 the lever 64 lies on one side of a cam disc 72, which cam disc is connected by a stub shaft 72 passing through the cover wall 30 with a rotary knob 76 lying on the cover wall 30. If only one cam dog 78 is provided on the disc 72, only one of the key rams 26 can be brought into its effective switch operating position. It is, however also possible that the disc 72 be provided with a plurality of cam dogs which can be so arranged that different combinations of key rams of the compound key can be brought into their effective switch operating positions. This can be understood from FIG. 7, which shows a plan view of the side of the disc carrying the cam dogs. In this figure the cam dogs belonging to a given switch combination are illustrated in the same way. It will be understood that still other cam dog combinations are possible besides those illustrated.

The embodiment according to FIGS. 8 to 10 differs from the previously described embodiments again by means of the type of adjustment of the key rams 26. On the cover wall 30 a lock cylinder 80 is rotatably supported in a non-illustrated way in the middle between the nipples 38. With the help of an unlocking key 82 insertable in the lock cylinder 80 an operating pin 84 in the lock cylinder 80 is pushed radially outwardly. This pin 84 has an inclined ramp face 86 so that upon a rotation of the lock cylinder 80 with the help of the key 82 the pin 84 slides into an opening in the nipple 38 and onto the head 50 of its key ram 26 and adjusts this ram downwardly. It can now also be provided that with the use of different unlocking keys different numbers of pins can be moveable outwardly in different combinations in order to bring a selected desired combination of the key rams to their effective switch operating positions. In this way by the operation of the same compound key different codings may for example be input into the associated device.

The key arrangements illustrated in FIGS. 11 to 19 each include only two individual keys and differ from one another by the different ways in which the key rams are adjusted.

Figure 11:
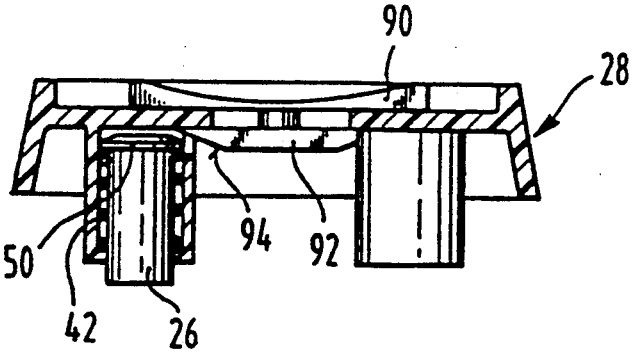
Figure 12:
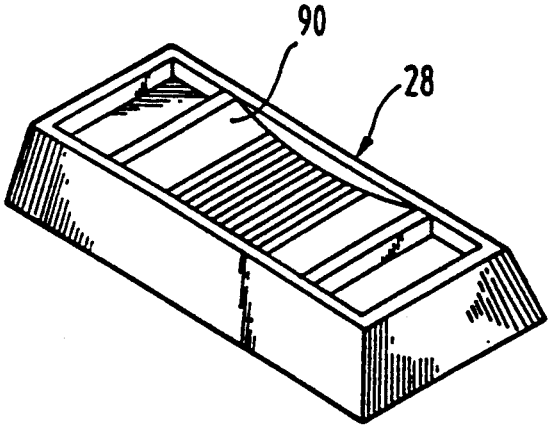

The adjusting mechanism in the embodiment according to FIGS. 11 and 12 corresponds essentially with the adjusting mechanism described in connection with FIGS. 3 and 4. A slide, indicated generally at 90, is supported on the cover wall 30 and on its adjusting element 92 located below the cover wall 30 it has ramp shaped inclined surfaces 94 one of which upon the sliding of the slide 90 in the direction toward one or the other of the two key rams 26 slides onto the head of the involved ram and thereby adjusts such ram downwardly against the force of its spring 42.

Figure 13:
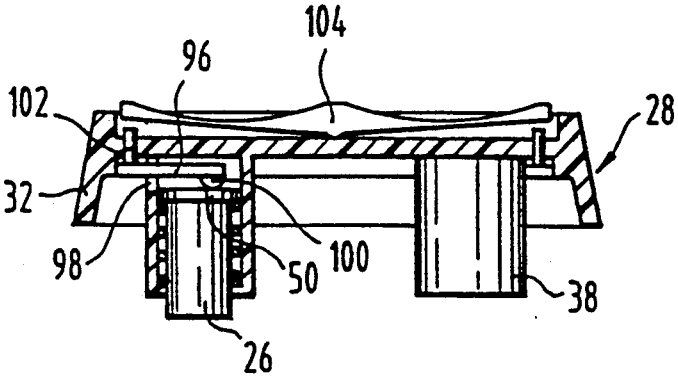
Figure 14:
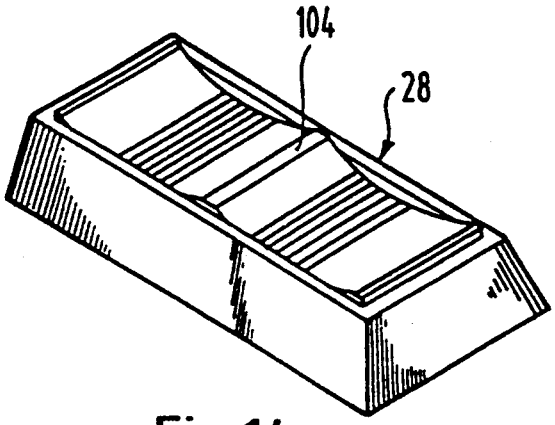

In the embodiment of FIGS. 13 and 14 the positioning member is formed by a pivotal lever 96 which is pivotally supported on the inner side of the rim 32 of the key head 22 and which projects radially through an opening 98 in the associated nipple 38 and lies on the head 50 of the key ram 26 with a cam 100. A pin 102 connected with the lever 96 projects through the cover wall 30. By operation of a switch rocker supported on the cover wall 30 the pin 102 can be pressed downwardly and thereby the pivot lever 96 is likewise pivoted downwardly.

Figure 15:
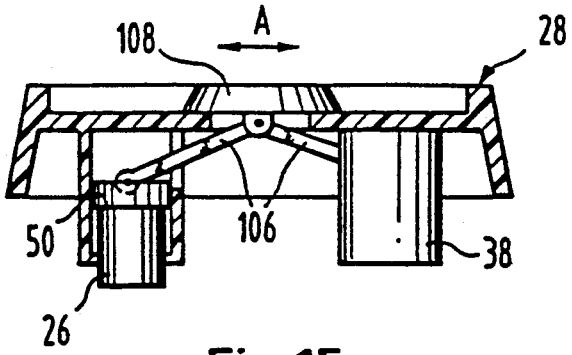
Figure 16:
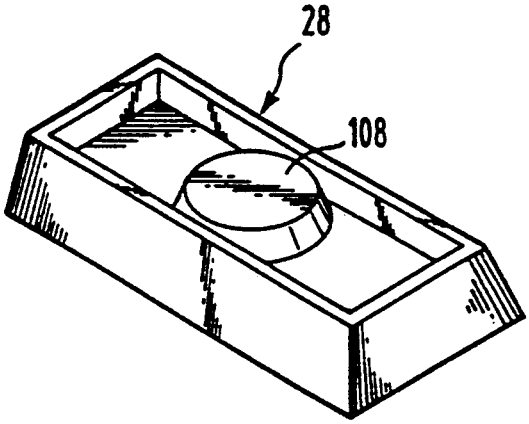

In the embodiment according to FIGS. 15 and 16 the heads 50 of the two key rams 26 are each connected with a slide 108 through a type of connecting rod 106 pivotally connected with a slide 108 which is slidably arranged on the upper side of the cover wall 30. As can be recognized, by a shifting of the slide 108 in the direction of the double arrow A one of the key rams can be adjusted downwardly and the other upwardly.

In the embodiment according to FIGS. 17 to 19 a shaft 110 is supported in the compound key head 28 below the cover wall 30 and passes diametrically through the nipples 38. Actuating cams 112 (FIG. 19) are arranged on the shaft 110 which cams operate on the heads 50 of the key rams 26. In the area of each nipple 38 the shaft 110 is connected with two non-rotatable tabs 114 on which the operating pins 116 work, the pins 116 passing through corresponding openings in the cover wall 30. These actuating pins 116 again can be pressed downwardly by an associated key button 118, whereby the associated cams 112 are so pivoted by means of the tabs 114 that the associated key ram is adjusted to its effective switch operating position. The cams 112 and the tabs 114 for the two key rams 26 are so arranged on the shaft 110 opposite to one another that upon actuation of the two key buttons 118 the shaft is in one case turned in one rotary direction and the other case turned in the opposite rotary direction, and upon the adjustment of one key ram to its effective switch operating position the other key ram is freed so that it may return again to its ineffective rest position.

All of the embodiments illustrated in FIGS. 11 to 19 have as a common factor that always only one of the two key rams 26 can be adjusted to its effective switch operating position.

We claim:

1. An alphanumeric keyboard including a plurality of switches (14,16) operable by keys and a cover frame (22) overlying the switches (14,16) with guide bosses (24) for key rams (26) carried by a key head (28) overlying the guide bosses (24), each of said guide bosses having a generally vertically extending bore, and means restricting said key head to translational movement relative to said cover frame in a keying direction extending parallel to the bores of said guide bosses characterized in that at least one compound key is associated with at least two switches (14,16) and has a compound key head (28) overlying at least two guide bosses, and that at least one of the rams (26) carried by said compound key head (28) is supported on said compound key head (28) for adjustment relative to said compound key head parallel to said keying direction.

2. A keyboard according to claim 1 further characterized in that said at least one ram (26) is connected with a key button (40) and is so supported on said compound key head (28) that by pressing on said compound key head (28) said at least one ram is movable in said keying direction in common with the other one or ones of the rams (26) carried by said compound key head and so that said at least one ram is also operable independently of said other ram or rams by pressing said key button (40) in said keying direction.

3. A keyboard according to claim 1 further characterized in that said compound key head is biased to a normal position and is movable away from said normal position in said keying direction by pressing it downwardly toward said cover frame, said at least one ram (26) is selectively adjustable relative to said compound key head between and effective position, in which upon a pressing down of said compound key head (28) the associated switch (14,16) is actuated, and an ineffective position, in which upon a pressing down of said compound key head (28) the associated switch (14,16) is not actuated.

4. A keyboard according to claim 3 further characterized by means carried by said compound key head (28) for releasably detaining said at least one ram in said effective and/or ineffective position.

5. A keyboard according to claim 3 further characterized in that said at least one adjustable ram is guided in a nipple (38) fixed to said compound key head (28) and is biased toward said ineffective position, in said at least one ram having a remote end located remote from the switch (14,16) associated therewith and said compound key having an upper side facing away from said cover frame, and in that said compound key head (28) has associated with it a moveable positioning element which operates on said remote end (50) of said at least one ram (26) and is operable from said upper side of said compound key head (28).

6. A keyboard according to claim 5 further characterized in that said positioning element (58;84;92) is arranged for radial adjustment relative to said at least one ram (26) and is provided with a ramp (60;86;94) which is slidable onto said remote end of said at least one ram (36).

7. A keyboard according to claim 6 further characterized in that said positioning element (58;92) is connected with a slide (56;90) moveable on the upper side of said compound key head (28).

8. A keyboard according to claim 5 further characterized in that said positioning element includes a cam (64,68;96,100;112) pivotally supported on said compound key head (28).

9. A keyboard according to claim 8 further characterized in that said positioning element (64,68) is actuated by means of a cam disc which is connected to a rotary knob supported on the upper side of said compound key head (28).

10. A keyboard according to claim 5 further characterized in that said positioning element (84) is adjustable by means of a key (82) operable lock device (80).

11. A keyboard according to claim 8 further characterized in that said positioning element (96,100) is operable by means of a switch rocker (104) supported on the upper side of the key head (28).

* * * * *